US005634239A

United States Patent [19]

Tuvin et al.

[11] Patent Number: 5,634,239

[45] Date of Patent: Jun. 3, 1997

[54] VACUUM CLEANER NOZZLE

[75] Inventors: Lars Tuvin, Knivsta; Holmer Ristau, Norsborg, both of Sweden

[73] Assignee: Aktiebolaget Electrolux, Stockholm, Sweden

[21] Appl. No.: 640,207

[22] Filed: Apr. 30, 1996

[30] Foreign Application Priority Data

May 16, 1995 [SE] Sweden ..... 9501810

[51] Int. Cl.[6] ..... A47L 9/06

[52] U.S. Cl. ..... 15/401; 15/415.1

[58] Field of Search ..... 15/415.1, 401, 15/402

[56] References Cited

U.S. PATENT DOCUMENTS

| | | | |
|---|---|---|---|
| 3,019,462 | 2/1962 | Nash et al. | 15/401 X |
| 3,566,432 | 3/1971 | Quinlan et al. . | |
| 4,164,055 | 8/1979 | Townsend | 15/401 X |
| 4,244,080 | 1/1981 | Wessel | 15/401 X |
| 4,723,336 | 2/1988 | Nakayama . | |
| 5,101,534 | 4/1992 | Watanabe et al. | 15/401 X |
| 5,307,536 | 5/1994 | Lescher . | |
| 5,575,035 | 11/1996 | Reis et al. | 15/401 X |

FOREIGN PATENT DOCUMENTS 2214787 9/1989 United Kingdom .

*Primary Examiner*—Chris K. Moore

*Attorney, Agent, or Firm*—Pearne, Gordon, McCoy & Granger LLP

[57] ABSTRACT

A vacuum cleaner nozzle having a nozzle body (10) having a nozzle opening (13) facing a surface to be cleaned and one or more scraper blades. The scraper blades have a single, strip-shaped piece (16), made from rubber, plastic or some other elastic material. The blade has a first edge part (18) resting on the surface (19) to be cleaned and a second, opposite edge part which is secured in a holder (17) in the nozzle body. The distance (A) of the holder from the surface being cleaned is mainly constant when the scraper blade is moved forwards or rearwards on a hard surface. The length of the blade (16) extending toward the surface from the holder under free conditions is larger than the distance (A) from the holder to the surface so that the first edge part (18) during forward and rearward movement will trail behind the holder, as seen in the direction of movement of the nozzle. The blade (16) is shaped and constructed such that when the direction of movement of the nozzle is reversed, the blade serves as a soft spring for forces which are applied on the first edge part (18) from the surface (19) toward the holder (17).

5 Claims, 1 Drawing Sheet

VACUUM CLEANER NOZZLE

BACKGROUND OF THE INVENTION

The present invention relates to a vacuum cleaner nozzle comprising a nozzle body having a nozzle or suction opening facing a surface to be cleaned, and one or more scraper blades extending downwardly from the nozzle body adjacent the nozzle opening. Such scraper blades have a single, strip-shaped piece, made from rubber, plastic or some other elastic material. The strip-shaped pieces have a first edge part resting on the surface to be cleaned and a second or opposite edge part which is secured to or mounted in a holder in the nozzle body. The distance of the nozzle body from the surface to be cleaned is mainly constant when the scraper blade is moved forwards or rearwards on a hard surface. The length of the strip-shaped piece extending towards the surface from the holder under free conditions is larger than the distance between the surface and the nozzle body so that the first edge part during forward and rearward movement will trail behind the holder as seen in the direction of movement of the nozzle.

Nozzles of the type described above are previously known. These nozzles are used on soft as well as hard surfaces and comprise a bottom plate facing the surface to be cleaned and have an elongated nozzle or suction opening extending generally perpendicular or transverse to the direction of movement of the nozzle. The nozzle is supported on a hard surface by means of several wheels which, with regard to flow conditions, define an optimal distance between the nozzle opening and the hard surface being cleaned.

Relatively behind the nozzle opening and parallel with it there are one or more rubber blades. These blades have a free length extending from the bottom plate toward the floor, the length being somewhat larger than the distance between the surface and the bottom plate. Such blades are used to convey dirt on a hard surface when moving the nozzle forwards, but they do not hinder the movement of the nozzle on a soft surface. Since the extending free length of the rubber blade is larger than the distance between the surface being cleaned and the bottom plate, the rubber blade will be somewhat curved when in contact with the surface, and the lower edge of the blade will trail with respect to the support point of the scraper blade in the nozzle. If the scraper blade is to perform properly, it has to be comparatively stiff so that the dirt really is conveyed by the scraper blade to the nozzle inlet when the nozzle is moved on a hard surface.

However, the use of a scraper blade also creates a disadvantage since the scraper blade, when the nozzle is moved on a surface, will lift the nozzle vertically when the nozzle is moved back and forth across the surface being cleaned. This is because the scraper blade, when the nozzle is moved in one direction (i.e., either forwardly or rearwardly), is first curved in one direction but, when the direction of nozzle movement is reversed, the nozzle first pivots about the blade, causing the blade to straighten and lift the nozzle off vertically from the floor. Thereafter, the scraper blade will curve in a second direction, opposite to the first, as the nozzle is moved in the opposite direction (i.e., either rearwardly or forwardly). Therefore, there exists a need in the art for a scraper blade which does not lift the nozzle during a change in direction of nozzle movement.

SUMMARY OF THE INVENTION

The present invention is directed toward a scraper blade which does not lift the nozzle off the surface being cleaned during back and forth movement of the nozzle.

In accordance with the present invention, a nozzle scraper blade includes a first edge part, a second edge part, and a resilient portion intermediate the first and second edge parts. The second edge part is secured to the nozzle, while the first edge part is operable to engage a surface being cleaned. The resilient portion serves as a soft spring to prevent lifting-up of the nozzle during back and forth movement of the nozzle and blade over the surface being cleaned.

BRIEF DESCRIPTION OF THE DRAWINGS

A preferred embodiment of the present invention will now be described in detail with reference to the accompanying drawings, wherein.

DETAILED DESCRIPTION OF THE PREFERRED EMBODIMENT

Figure 1:
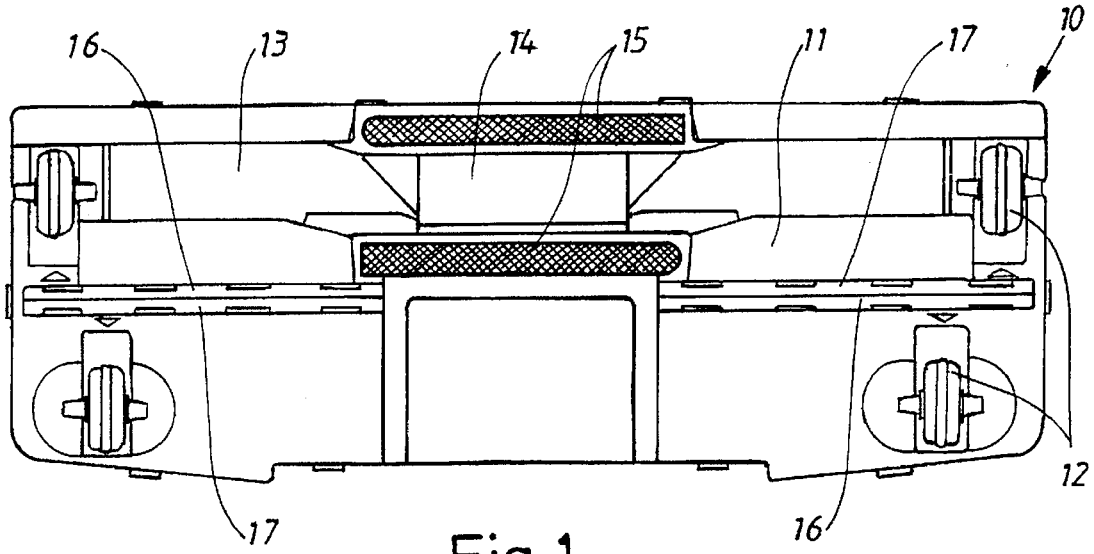
FIG. 1 is a bottom plan view of a vacuum cleaner nozzle, incorporating a scraper blade according to the present invention.
Figure 2:
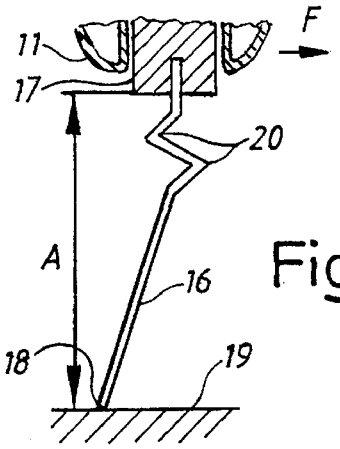
FIG. 2 is a vertical section of the scraper blade when the nozzle is moved in a certain direction on a surface.
Figure 3:
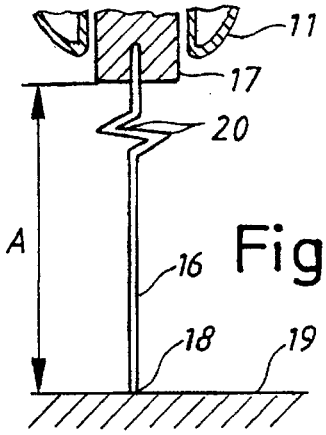
FIG. 3 is a vertical section of the scraper blade similar to FIG. 2, but wherein the nozzle is being moved in an opposite direction and is pivoting about the scraper blade.
Figure 4:
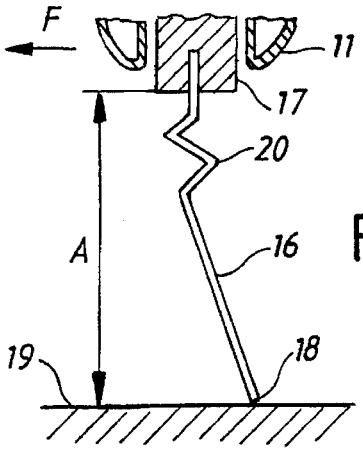
FIG. 4 is a vertical section similar to FIGS. 2 and 3, but wherein the nozzle is moved in the opposite direction relative to that shown in FIG. 2.

With reference to FIG. 1, a nozzle body 10 is shown to include a bottom plate 11 on which several distance means in the form of wheels 12 or low friction surfaces are arranged. The nozzle body 10 has an elongated nozzle opening 13 with a centrally arranged suction inlet 14 for the air which flows into the nozzle and which is transported to a tube shaft (not shown), which is connected to the nozzle and to a vacuum cleaner (not shown). The wheels 12 are fastened to the nozzle body 10 in such a way that a slot or space is created between the nozzle opening 13 and a hard surface over which the nozzle body 10 is moved. The distance between the nozzle opening 13 and the hard surface being cleaned is optimized so that suitable flow conditions are achieved when the nozzle is moved over the surface. The nozzle also has conventional thread pick up devices 15 arranged centrally in front of and behind the nozzle opening 13 and scraper blades 16 made from elastic material arranged behind the nozzle opening.

The scraper blade 16 is fastened to a holder 17 which is arranged parallel to the nozzle opening 13 and perpendicular to the direction of movement F of the nozzle. The scraper blade 16 comprises an elongated, strip-shaped, single or unitary piece made from rubber, plastic or similar elastic or resilient material. A lower edge 18 of the scraper blade 16 abuts the surface 19. The free length of the blade extending from the holder 17 towards the surface, i.e., the length of the blade 16 when not loaded or supporting the nozzle body 10, is larger than a distance A between the lower edge of the holder 17 and the surface 19.

The scraper blade 16 has one or more folds 20 or pleats close to the holder 17, the folds 20 extending perpendicular to the direction of movement of the nozzle 10 and lengthwise of the blade 16. The existence of these folds 20 means that the "spring constant" for the overall blade, as well as for the upper part of the blade, is reduced with respect to the lower part of the blade when acting on it in the vertical direction.

Thus, the blade 16 has such a shape and such properties that during the turning motion of the nozzle, the blade serves as a soft spring for forces which from the surface are applied on the first edge part 18 towards the holder 17. The folds 20 absorb or dampen these forces, and prevent the blade 16 from lifting the nozzle body 10 off the surface 19, and maintain the holder 17 the predetermined optimal distance A from the surface 19 being cleaned.

It should be mentioned that the section 20 of the blade 16 which has the resilient properties can have many different shapes besides the above-noted folds or pleats. Instead of using folds, more or less curved shapes could be used as well as portions extending symmetrically at two sides of the piece. It is also possible to vary the thickness of the resilient material in order to achieve the resilient properties desired.

Therefore, it is considered apparent that the present invention is not limited to the structural features of the preferred embodiment described hereinbefore, but shall only be defined by the claims appended hereto.

What is claimed is:

1. A vacuum cleaner nozzle comprising a nozzle body (10) and a scraper blade, said nozzle body having a nozzle opening (13) facing a surface to be cleaned, said scraper blade comprising a single, strip-shaped piece (16), made from an elastic material and having a first edge part (18) resting on said surface (19) and a second opposite edge part which is received in a holder (17) in the nozzle body, said nozzle body being maintained a generally constant distance (A) from the surface when the scraper blade is moved forwards or rearwards on a hard surface, the length of the piece (16) extending toward the surface from the holder under free conditions being larger than said generally constant distance (A) so that the first edge part (18) during said movement trails behind the holder as seen in the direction of movement of the nozzle, wherein the piece (16) serves as a soft spring when the direction of movement of the nozzle is reversed, and thereby dampens forces which are applied on the first edge part (18) toward the holder (17).

2. A nozzle according to claim 1, wherein the strip-shaped piece (16) extends generally perpendicular to the direction (F) of movement of the nozzle.

3. A nozzle according to claim 1, wherein the strip-shaped piece has at least one fold (20) therein.

4. A nozzle according to claim 3, wherein the fold (20) is relatively closer to the second edge part than to the first edge part.

5. A nozzle according to claim 4, further comprising wheels which maintain the holder (17) at said constant distance from said surface (19).

* * * * *